US006375702B1

(12) United States Patent
Knudsen et al.

(10) Patent No.: US 6,375,702 B1
(45) Date of Patent: Apr. 23, 2002

(54) CONSUMABLE ELECTRODE ELECTROSLAG REFINING FEED SYSTEMS AND METHODS

(75) Inventors: Bruce Alan Knudsen, Amsterdam; Robert John Zabala, Schenectady; Mark Gilbert Benz, Burnt Hills; William Thomas Carter, Jr., Galway, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/511,196

(22) Filed: Feb. 23, 2000

Related U.S. Application Data

(60) Provisional application No. 60/121,184, filed on Feb. 23, 1999.

(51) Int. Cl.[7] ..... C22B 9/18

(52) U.S. Cl. ..... 75/10.14; 75/10.24; 164/266; 266/44; 266/201

(58) Field of Search ..... 75/10.24, 10.14; 266/44, 201; 164/266

(56) References Cited

U.S. PATENT DOCUMENTS

| | | | | |
|---|---|---|---|---|
| 3,752,896 A | | 8/1973 | Zimmermann et al. | |
| 4,238,633 A | * | 12/1980 | Medovar et al. | 373/52 |
| 5,160,532 A | | 11/1992 | Benz et al. | |
| 5,310,165 A | | 5/1994 | Benz et al. | |
| 5,325,906 A | | 7/1994 | Benz et al. | |
| 5,348,566 A | | 9/1994 | Sawyer et al. | |
| 5,381,847 A | | 1/1995 | Asok et al. | |
| 5,472,177 A | | 12/1995 | Benz et al. | |
| 5,480,097 A | | 1/1996 | Carter, Jr. et al. | |
| 5,649,993 A | | 7/1997 | Carter, Jr. et al. | |
| 5,683,653 A | | 11/1997 | Benz et al. | |
| 5,769,151 A | | 6/1998 | Carter, Jr., et al. | |
| 5,809,057 A | | 9/1998 | Benz et al. | |
| 5,810,066 A | | 9/1998 | Knudsen et al. | |

FOREIGN PATENT DOCUMENTS

| | | |
|---|---|---|
| DE | 3148402 | 6/1983 |
| GB | 2058528 | 4/1981 |

OTHER PUBLICATIONS

Derwent Acc–No. 1983–59016K for Boiko et al, DE–3148402 published Dec. 7, 1981 and JP–0206327 published Dec. 22, 1981.*

Japanese Abstract (Japanese Patent 04072039, Mar. 6, 1992).

* cited by examiner

*Primary Examiner*—Roy King
*Assistant Examiner*—Tima McGuthry-Banks
(74) *Attorney, Agent, or Firm*—Robert P. Santandrea; Noreen C. Johnson

(57) ABSTRACT

A consumable electrode feed system for a refining system provides consumable electrodes to a refining system. The consumable electrode feed system comprises a side feed device that feeds consumable electrodes to a refining system in a first direction; a refining feed device that feeds consumable electrodes to a refining system in a second direction, in which the second direction being generally orthogonal to the first direction; and a connection system for connecting fed consumable electrodes to each other. The consumable electrode feed system allows for a predetermined amount of a consumable electrode to be refined in the refining system, and can position another consumable electrode above a previously fed consumable electrode. The connecting system then can connect a fed consumable electrode to a previously fed consumable electrode thus avoiding refining operation.

42 Claims, 3 Drawing Sheets

CONSUMABLE ELECTRODE ELECTROSLAG REFINING FEED SYSTEMS AND METHODS

This application claims priority of a Provisional Application entitled "Continuous Feed Electroslag Refining Furnace" by Knudsen et al., U.S. Ser. No. 60/121,184, which was filed on Feb. 23, 1999.

BACKGROUND OF THE INVENTION

The invention relates to refining systems and methods. In particular, the invention relates to consumable electrode feed systems and methods for refining systems.

Some conventional refining systems utilize ingots as a source of raw metal to be refined. For example, electroslag refining systems may use a consumable electrode, both as a source of raw metal and as a part of an electrical circuit used in the electroslag refining for melting the ingot. These electroslag refining systems and methods, substantial preparation may be needed for placement and utilization of the consumable electrodes. Typically, consumable electrodes have been attached to a vertical motion control apparatus, such as a stub attached to a motive device, which provides mechanical movement of the consumable electrode into the electroslag refining system. The vertical motion control apparatus can comprise a weld between the consumable electrode and a stub of the vertical motion control apparatus, a screw or bolt-like connection between the consumable electrode and a stub of the vertical motion control apparatus, clamps between the consumable electrode and a stub of the vertical motion control apparatus, and other vertical motion control structures between the consumable electrode and a stub of the vertical motion control apparatus. The vertical motion control apparatus also provides electrical contact between the consumable electrode and an electrical power supply.

Electroslag refining melting of the consumable electrode and the movement of the consumable electrode is typically stopped prior to reaching an end of the consumable electrode that is remote from the consumable electrode end in cooperation with the electroslag refining system. The movement stoppage is needed to replace the existing consumable electrode by providing a new consumable electrode for refining in the electroslag refining system, and connecting the new consumable electrode to the vertical motion control apparatus. The movement stoppage is needed to avoid damaging components of the vertical motion control apparatus, for example if vertical motion control apparatus components get too close to the melt in the electroslag refining system. The movement stoppage should avoid contaminating the electroslag-refined melt, for example by contaminants originating from the vertical motion control apparatus. This movement stoppage, while needed in conventional electroslag refining systems, is undesirable since it reduces time that the electroslag refining system is in operation, results in a electroslag refining yield losses, increases electroslag refining system down time, and could increase contamination to the electroslag refining system.

Electroslag refining (ESR) systems and methods are known in the art. For example, electroslag refining systems, methods, and related features are set forth in U.S. Pat. No. 5,160,532 to Benz et al., which also discloses a cold induction guide (CIG) transfer device. Additional electroslag refining systems, methods, and related features are set forth in the following U.S. Patents, all of which are assigned to the Assignee of the instant invention and of which the contents are fully incorporated by reference: U.S. Pat. No. 5,160,532 to Benz et al.; U.S. Pat. No. 5,310,165 to Benz et al.; U.S. Pat. No. 5,325,906 to Benz et al.; U.S. Pat. No. 5,348,566 to Sawyer et al.; U.S. Pat. No. 5,366,206 to Sawyer et al.; U.S. Pat. No. 5,472,177 to Benz et al.; U.S. Pat. No. 5,480,097 to Carter, Jr. et al.; U.S. Pat. No. 5,649,992 to Carter, Jr. et al.; U.S. Pat. No. 5,649,993 to Carter, Jr. et al.; U.S. Pat. No. 5,683,653 to Benz et al.; U.S. Pat. No. 5,769,151 to Carter, Jr. et al.; U.S. Pat. No. 5,809,057 to Benz et al.; and U.S. Pat. No. 5,810,066 to Knudsen et al.

Further, difficulty encountered in forming castings, for example large diameter castings, such as those with diameters greater than about 18 inches (about 45 centimeters) may be increased during movement stoppage, connecting and changing the consumable electrode. The casting process of a large diameter ingot typically uses several consumable electrodes, which have been connected to the vertical motion control apparatus. Inhomogeneous regions may arise in the resulting casting during any consumable electrode connection operations. These inhomogeneous regions may result from minor constituent variations in the consumable electrodes, contaminants that may enter the electroslag refining melt during movement stoppage and consumable electrode connection operations, differing electroslag refining conditions before and after movement stoppage, and other such electroslag refining variables. These inhomogeneous regions are, of course, undesirable in the resulting casting and any article, such as, but not limited to, turbine components formed from the casting.

Thus, a need exists for providing consumable electrodes for electroslag refining systems and methods that avoid movement stoppage of electroslag refining. Further, a need exits for providing electroslag refining systems and methods that avoid yield loss, contamination during electroslag refining, and damage to vertical motion control apparatus. Further, a need exists for electroslag refining systems and methods that avoid forming inhomogeneous regions during consumable electrode movement stoppage and consumable electrode connection operations.

SUMMARY OF THE INVENTION

An aspect of the invention sets forth a consumable electrode feed system for a refining system. The consumable electrode feed system comprises a side feed device that feeds consumable electrodes to a refining system in a first direction; a refining feed device that feeds consumable electrodes to a refining system in a second direction, in which the second direction being generally orthogonal to the first direction; and a connection system for connecting fed consumable electrodes to each other. The consumable electrode feed system allows for a predetermined amount of a consumable electrode to be refined in the refining system, and can position another consumable electrode above a previously fed consumable electrode. The connecting system then can connect a fed consumable electrode to a previously fed consumable electrode thus avoiding interrupting refining.

The invention sets forth a method for feeding consumable electrodes to a refining system. The method of feeding comprises feeding consumable electrodes to a refining system in a first direction; feeding consumable electrodes to a refining system in a second direction, the second direction being generally orthogonal to the first direction; connecting fed consumable electrodes to each other; and refining the consumable electrodes as they are fed to the refining system. The method permits a predetermined amount of a consumable electrode to be refined in the refining system, feeding another consumable electrode above a previously fed consumable electrode, and connecting a consumable electrode to a previously fed consumable electrode for avoiding refining operation stoppage.

A further aspect of the invention provides a consumable electrode feed system for providing consumable electrodes to an electroslag refining system. The electroslag refining system comprises a cold induction guide. The consumable electrode feed system comprises a side feed device for feeding consumable electrodes to a refining system in a first direction, in which the side feed device is selected from at least one of conveyors, cranes, tracks, lifts, and combinations thereof for orienting a consumable electrode in a disposition to be fed to the refining feed device; a refining feed device for feeding consumable electrodes to a refining system in a second direction, wherein the second direction is generally orthogonal to the first direction and the refining feed device is selected from caterpillar devices, treaded devices, belt devices, chain devices, and combinations thereof for controlled movement of the consumable electrode to the refining system; and a connection system for connecting fed consumable electrodes to each other. The connection system is selected from at least one of weld connection systems, brazing connection systems, soldering connection systems, fusing connection systems, and combinations thereof. As a predetermined amount of a consumable electrode has been refined in the refining system, another consumable electrode is positioned above a previously consumable electrode by the side feed device. The connecting system then can connect a fed consumable electrode to a previously fed consumable electrode, thus avoiding refining operation stoppage for providing consumable electrodes for refining.

Another aspect of the invention provides an electroslag refining system comprising a consumable electrode feed system. An electroslag refining system comprises an electroslag refining structure; a cold health structure; and a consumable electrode feed system for providing consumable electrodes to the electroslag refining system. The consumable electrode feed system comprises a side feed device that feeds consumable electrodes to the electroslag refining system in a first direction; a refining feed device that feeds consumable electrodes to the electroslag refining system in a second direction, the second direction being generally orthogonal to the first direction; and a connection system that connects fed consumable electrodes to each other. The electroslag refining system with the consumable electrode feed system allows a predetermined amount of a consumable electrode to be refined in the electroslag refining system, and another consumable electrode is positioned above a previously consumable electrode by the side feed device. The connecting system connects a fed consumable electrode to a previously fed consumable electrode, thus avoiding refining operation stoppage for providing consumable electrodes for refining by the electroslag refining system.

These and other aspects, advantages, and features of the invention will become apparent from the following detailed description, which, when taken in conjunction with the annexed drawings, where like parts are designated by like reference characters throughout the drawings, disclose embodiments of the invention.

DESCRIPTION OF THE INVENTION

The consumable electrode feed system, as embodied by the invention, provides consumable electrodes to a refining system that utilizes ingots as a source of raw metal to be refined. The consumable electrode feed system provides the consumable electrodes in a manner that is sufficient for avoiding consumable electrode movement stoppage and stoppage of the refining operations while connecting a new consumable electrode. The consumable electrode feed system connects a consumable electrode to a consumable electrode, which is already in the refining system, in a manner that avoids refining operation stoppage, enhances refining yield, decreases refining system downtime, and can decrease contamination of the refining system.

The consumable electrode feed system, as embodied by the invention, can be applied to any appropriate metal refining system that uses ingots as its raw metal source. The following description will refer to the consumable electrode feed system provided with an electroslag refining system. Electroslag refining (ESR) typically comprises a method for melting and refining metals. The metals can comprise any appropriate metal, such as, but not limited to, iron (Fe), nickel (Ni), copper (Co), and titanium (Ti)-based alloys, in which the metals may be used in turbine component applications. An electroslag refining system may be coupled with a cold induction guide (CIG) that can include an induction-heated, segmented, cooled copper guide tube. The cold induction guide can be disposed at a bottom of the electroslag refining system. A liquid metal stream can be extracted from the liquid metal pool through the cold induction guide. This stream may be a liquid metal source for many solidification methods, comprising, but not limited to, powder atomization, spray deposition, investment casting, melt-spinning, strip casting, slab casting, and nucleated casting. This electroslag refining system description is merely for exemplary purposes only and is not intended to limit the invention in any manner. Other metal refining systems are within the scope of the invention.

Figure 1:
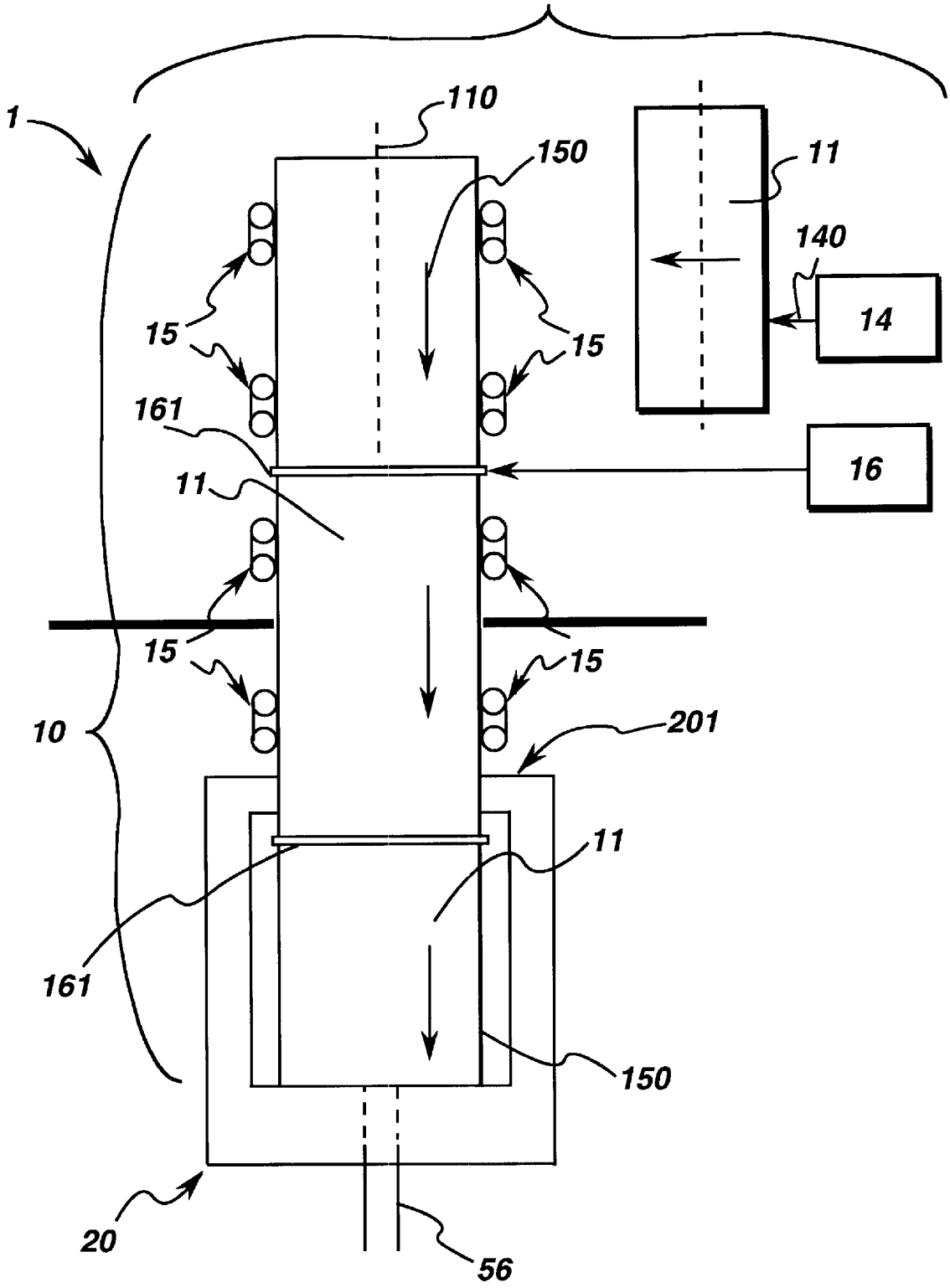
FIG. 1 is a side schematic illustration of a consumable electrode feed system, as embodied by the invention.

In FIG. 1, consumable electrodes 11 are fed into the consumable electrode feed system 10 from a position generally disposed over an electroslag refining system 20. The term "top" and other relative positioning terms are used herein with respect to the illustrations, and are not meant to limit the orientation of the invention. Further, other terms are used with their normal meanings, as understood by a person of ordinary skill in the art, except where noted. The consumable electrode feed system 10 comprises a side consumable electrode feed device or system 14 (hereinafter "side feed device") that moves a consumable electrode in a first direction (arrow 140) in an orientation or disposition to be fed to a refining feed device or system 15 (described hereinafter). The side feed device 14 can comprise any appropriate device, such as but not limited to, conveyors, cranes, tracks, lifts, and other motive devices that can orient the consumable electrode 11 in a disposition to be fed to the consumable electrode feed system 10, as embodied by the invention.

The side feed device 14 may position consumable electrodes 11 in an orientation with their longer longitudinal axis 110 aligned with a previous consumable electrode's longitudinal axis 110 in the refining feed device 15. The position may be vertical, as illustrated in FIG. 1. The side feed device 14 delivers consumable electrodes to a refining feed device 15. The refining feed device 15 can move consumable electrodes 11 in a second direction (arrow 150), which is generally orthogonal to the first direction 140. The consumable electrode feed system 10 also comprises a connection system 16 for connecting consumable electrodes together in a manner that is sufficient to avoid stoppage during refining.

The refining feed device 15 comprises a device that can move the consumable electrode 11 through the connecting system 16 into the refining system 20. The refining feed device 15 may comprise any lowering motive device that can provide controlled movement and descent of the consumable electrodes 11. The controlled movement and descent may be controlled by the rate of melting in the refining system 20. For example, the controlled descent may comprise a stepped movement and descent. The refining feed device 15, which moves the consumable electrode 11 into the refining system, can comprise any motive device that can provide the appropriate lowering and control to the consumable electrode. The refining feed device can comprise caterpillar devices, treaded devices, belt devices, chain devices, other such motive devices, and combinations thereof that can provide controlled movement of the consumable electrode to a refining system.

Each consumable electrode 11 is connected to a previously positioned consumable electrode by a connection system 16 of the consumable electrode feed system 10. The connection system 16, as embodied by the invention, comprises a system that connects consumable electrodes together so that each respective consumable electrode is delivered by the refining feed device 15 to the refining system without gaps therebetween. For example, and in no way limiting of the invention, the connecting system 16 can connect consumable electrodes by at least one of mechanical conceptions, metallurgical connections, and combinations thereof.

Accordingly, the consumable electrode feed system 10, as embodied by the invention, provides a consumable electrode 11 for connection to a previous consumable electrode 11 so that movement stoppage is avoided.

The connection system 16, as embodied by the invention, may comprise a welding connection system to connect consumable electrodes 11. The welding connection system 16 may comprise any conventional welding system. Alternatively, the connection system 16 can comprise any other device that can mechanically connect consumable electrodes. Further, as another alternative, the connecting system 16 comprises any system that can metallurgically connect consumable electrodes. For example, and in no way limiting of the invention, the connecting system 16 can comprise brazing connection systems, soldering connection systems, fusing connection systems, and systems that include combinations thereof.

The connection system 16 that connects the respective consumable electrodes need not provide a heavy-duty connection, in which the term "heavy-duty means that the connection would support large amounts of current and weight. The connection between consumable electrodes merely carries weight of the consumable electrode, and is not intended to carry current for an electroslag refining process. The following description will refer to the connection system 16 comprising a weld connection system, however, this description is merely for exemplary purposes. The description of a weld connection system is not intended to limit the invention in any manner.

The weld connection system in the consumable electrode feed system 10 can be formed by any weld connection operation. For example, the weld connection between consumable electrodes can be automatically formed, such as by a robotic welding machine. Alternatively, a welder can form the weld. The welder can be positioned at a connection station, such as but not limited to a connection platform 21. The connection platform 21 may be disposed above the electroslag refining system 20. Further, any connection system 16, which is within the scope of the invention, may be provided at the connection platform 21.

The continuous feed system 10, and its associated method, for an electroslag refining system 1 is illustrated in FIG. 1 in combination with a bottom pouring electroslag refining system. This illustrated configuration is merely exemplary of the systems within the scope of the invention. The continuous feed system 10, and its associated method, for an electroslag refining system 1 can be adapted to conventional electroslag refining systems, withdrawal-mold electroslag refining systems, electroslag refining/cold induction guide systems (ESR/CIG), and nucleated casting systems, alone or in combination with ESR/CIG systems.

Figure 2:
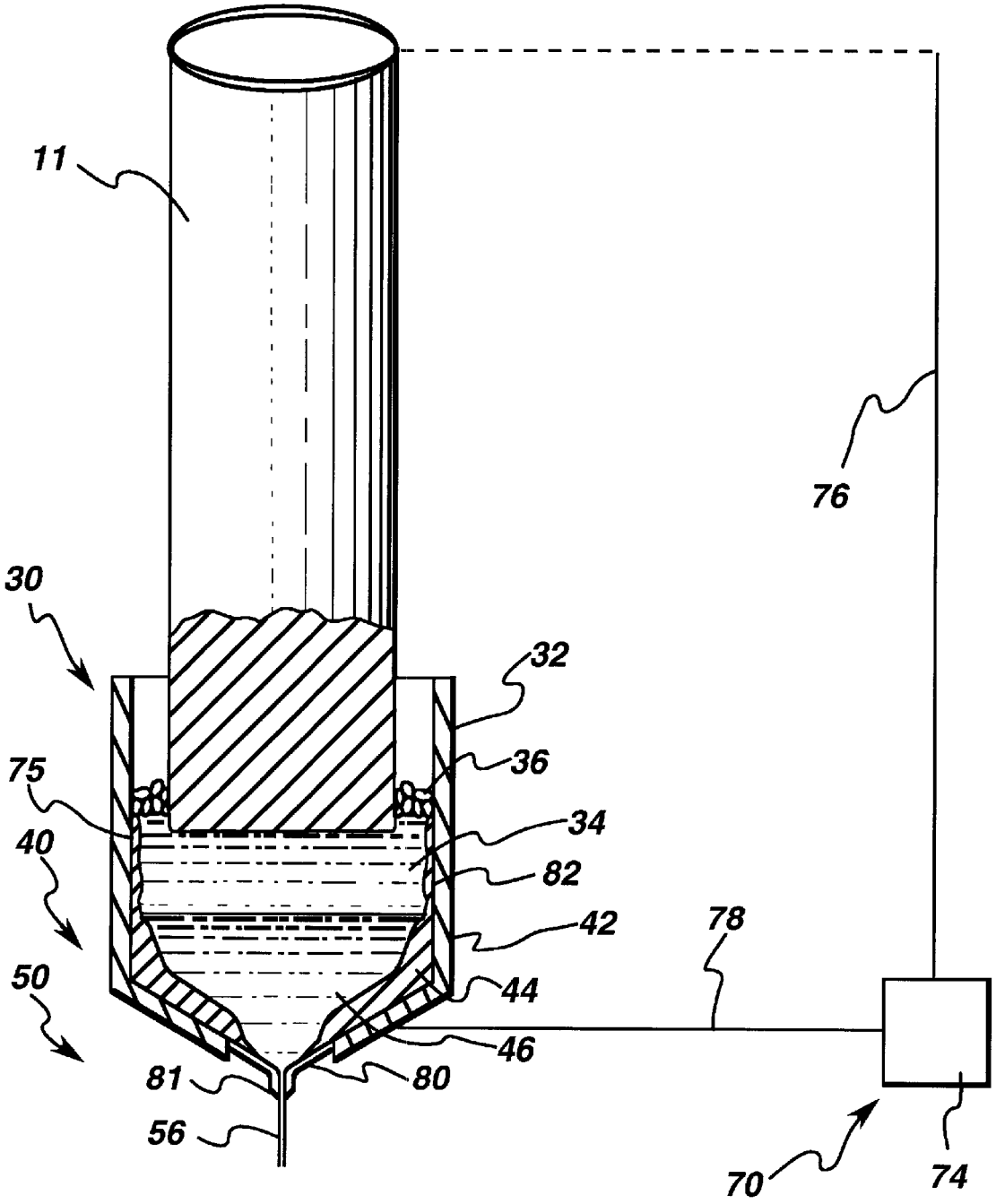
FIG. 2 is a schematic illustrations of an exemplary electroslag refining (ESR) with a cold induction guide (CIG) system.
Figure 3:
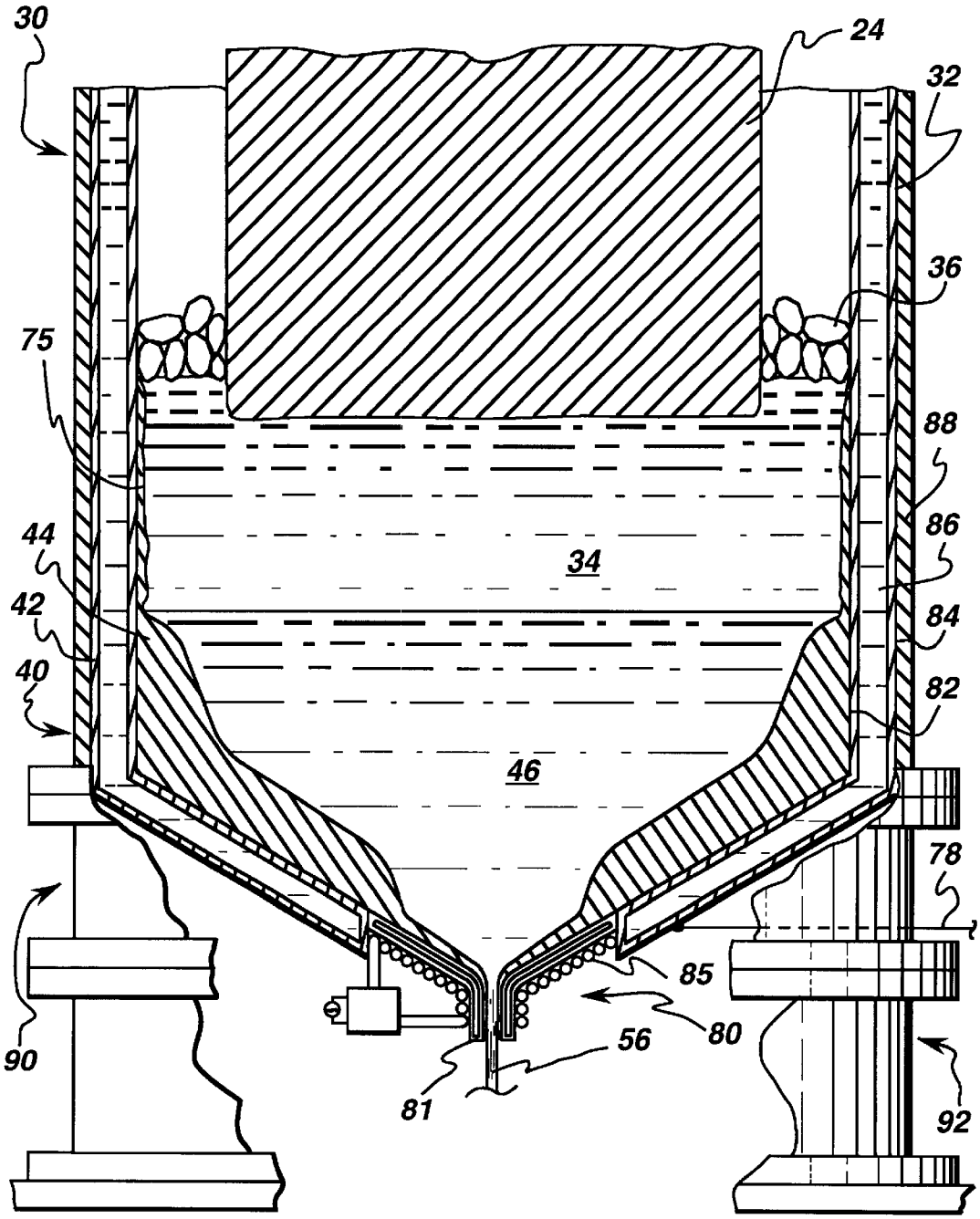
FIG. 3 is a further schematic illustration of an exemplary electroslag refining/cold induction guide system.

FIGS. 2 and 3 illustrate features of the electroslag refining system 20, into which the consumable electrode 11 is fed by the consumable electrode feed system 10, as embodied by the invention. The electroslag refining system 20 refines the consumable electrode 11 to produce a clean, refined metal melt 46 (hereafter "clean metal"). The clean metal 46 is received and retained within a cold hearth structure 40 that is mounted below the electroslag refining system 20. The clean metal 46 is dispensed from the cold hearth structure 40 through a cold finger orifice structure 80 that is mounted and disposed below the cold hearth structure 40.

The electroslag refining system 20 can provide essentially steady state operation in supplying clean metal 46 if the rate of electroslag refining of metal and rate of delivery of refined metal to a cold hearth structure 40 approximates the rate at which molten metal 46 is drained from the cold hearth structure 40 through an orifice 81 of the cold finger orifice structure 80. Thus, the electroslag refining with the consumable electrode feed system 10, as embodied by the invention, can provide continuous operation for an extended period of time and, accordingly, can process a large bulk of metal.

The electroslag refining system 20 comprises a passage 201 that is disposed in an upper portion of the electroslag refining system 20. The passage 201 is dimensioned to allow passage of a consumable electrode 11 for refining. The passage 201 may be formed of a fixed size if only one size consumable electrode is to be refined by the refining system, and alternatively can be provided with a varying passage dimension to allow varying sizes of consumable electrodes to pass therethrough. The passage 210 forms a seal with a consumable electrode, in which the seal is sufficient to prevent passage of contaminants to enter the refining system.

The electroslag refining system 20 comprises an electroslag refining structure 30. The electroslag refining structure 30 may comprise a reservoir 32 that is cooled by an appropriate coolant, such as, but not limited to, water. The reservoir 32 comprises a molten slag 34, in which an excess of the slag 34 is illustrated as the solid slag granules 36. The slag composition may vary with the metal being refined. A slag skull 75 may be formed along inside surfaces of an inner wall 82 of reservoir 32, due to the cooling influence of the coolant flowing against the outside of inner wall 82, as described hereinafter.

A cold hearth structure 40 is mounted below the electroslag refining structure 30. The cold hearth structure 40 comprises a hearth 42, which is cooled by an appropriate coolant, such as water. The hearth 42 contains a skull 44 of solidified refined metal and a body 46 of refined liquid metal. The reservoir 32 may be formed integrally with the hearth 42. Alternatively, the reservoir 32 and hearth 42 may be formed as separate units, which are connected to form the electroslag refining system 20.

A bottom orifice 81 of the electroslag refining system 20 is provided in the cold finger orifice structure 80, which is described with reference to FIGS. 3 and 4. A clean metal 46, which is refined by the electroslag refining system 20 so as to be essentially free of oxides, sulfides, and other impurities, can traverse the electroslag refining system 20 and flow out of the orifice 81 of the cold finger orifice structure 80.

A power supply structure 70 can supply electric refining current to the electroslag refining system 20 and the consumable electrode 11. The power supply structure 70 can comprise an electric power supply and control mechanism 74. An electrical conductor 76 that is able to carry current to the consumable electrode 1. A conductor 78 is connected to the reservoir 32 to complete a circuit for the power supply structure 70 of the electroslag refining system 20.

FIGS. 2 and 3 illustrate a detailed part-sectional illustration of the electroslag refining structure 30 and the cold hearth structure 40, in which the electroslag refining structure 30 defines an upper portion of the reservoir 32 and the cold hearth structure 40 defines a lower portion 42 of the reservoir 32. The reservoir 32 generally comprises a double-walled reservoir, which includes an inner wall 82 and outer wall 84. A coolant 86, such as but not limited to water, is provided between the inner wall 82 and outer wall 84. The coolant 86 can flow to and through a flow channel, which is defined between the inner wall 82 and outer wall 84 from a supply and through conventional inlets and outlets (not illustrated in the figures). The coolant 86 that cools the wall 82 of the cold hearth structure 40 provides cooling to the electroslag refining structure 30 and the cold hearth structure 40 to cause the skull 44 to form on the inner surface of the cold hearth structure 40. The coolant 86 is not essential for operation of the electroslag refining system 20, clean metal nucleated casting system 3, or electroslag refining structure 30. Cooling may insure that the liquid metal 46 does not contact and attack the inner wall 82, which may cause some dissolution from the wall 82 and contaminate the liquid metal 46. The cold hearth structure 40 also comprises an outer wall 88, which may include flanged tubular sections, 90 and 92. Two flanged tubular sections 90 and 92 are illustrated in the bottom portion of FIG. 2.

The cold hearth structure 40 comprises a cold finger orifice structure 80 that is shown detail FIGS. 2 and 3. The cold finger orifice structure 80 is illustrated in relation to the cold hearth structure 40 and a stream 56 of liquid melt 46 that exits the cold hearth structure 40 through the cold finger orifice structure 80. The cold finger orifice structure 80 is in structural cooperation with the solid metal skull 44 and liquid metal 46, and comprises orifice 81 from which processed molten metal 46 is able to flow in the form of a stream 56. The cold finger orifice structure 80 is connected to the cold hearth structure 40 and the cold hearth structure 30. Therefore, the cold hearth structure 40 allows processed and generally impurity-free alloy to form the skulls 44 and 83 by contacting walls of the cold hearth structure 40.

The skulls 44 and 83 thus act as a container for the molten metal 46. Additionally, the skull 83 (FIG. 3), which is formed at the cold finger orifice structure 80, is controllable in terms of its thickness, and is typically formed with a smaller thickness than the skull 44. The thicker skull 44 contacts the cold hearth structure 40 and the thinner skull 83 contacts the cold finger orifice structure 80, and the skulls 44 and 83 are in contact with each other to form an essentially continuous skull.

The amount of heating or cooling that is provided through the cold finger orifice structure 80 to the skulls 44 and 83, as well as to the liquid metal 46, can be controlled to control the passage of liquid metal 46 through the orifice 81 as a stream 56. The controlled heating or cooling is done by controlling the amount of current and coolant that pass in induction coils 85 that are connected to the cold finger orifice structure 80. The operation of the induction coils 85 for controlled heating or cooling of the cold finger orifice structure 80 is described in the above-noted patents. The controlled heating or cooling can increase or decrease the thickness of the skulls 44 and 83, and can open or close the orifice 81, and can reduce or increase the passage of the stream 56 through the orifice 81. More or less liquid metal 46 can pass through the cold finger orifice structure 80 into the orifice 81 to define the stream 56 by increasing or decreasing the thickness of the skulls 44 and 83. The flow of the stream 56 can be maintained at a desirable balance, by controlling coolant water and heating current and power to and through the induction heating coils 85 to maintain the orifice 81 at a set passage size along with controlling the thickness of the skulls 44 and 83.

The process using the consumable electrode feed system, as embodied by the invention, with an electroslag refining system 20 is conducted by moving a consumable electrode 11 ("fed consumable electrode") by the side feed device 14. The fed consumable electrode 11 is moved to a position disposed generally over a previously fed consumable electrode 11 that is located in the refining feed device 15. For example, the previously fed consumable electrode 11 in the refining feed device 15 may already be disposed in the electroslag refining system 20 or connected to another consumable electrode in the electroslag refining system 20. The side feed device 14 orients and moves the fed consumable electrode 11 over the previously fed consumable electrode that immediately preceded it into the consumable electrode feed system 10. The previously fed consumable electrode can be the consumable electrode that is being melted or the consumable electrode that is in sequence to be melted. The fed consumable electrode 11 can be moved to the consumable electrode feed system 10 when a predetermined mass of the previously fed consumable electrode 11 has been moved into or melted into the electroslag refining system 20.

Once the fed consumable electrode 11 is disposed in the refining feed device 15, the refining feed device 15 moves the consumable electrode in the direction of arrow 150 toward the connection system 16 and the refining system 20. The movement of the fed consumable electrode can comprise a movement and descent that is stepped. The controlled movement and descent of the fed consumable electrode by the refining feed device 15 is sufficient to provide ends of adjacent fed and preciously fed consumable electrodes at the connecting system 16. The connecting system 16 of the consumable electrode feed system 10 can then connect these consumable electrodes so that consumable electrodes are presented in a manner in which gaps or separations between the consumable electrodes is avoided. Further, consumable electrodes are presented in a manner in which stoppage of the refining is avoided, thus the consumable electrode feed system can provided essentially a continuous consumable electrode for refining.

The consumable electrode feed system 10, and its use in refining systems avoids contaminating the refined melt and damaging the consumable electrode movement device, and thus does not result in a yield loss. The consumable electrode feed system 10 also facilitates large diameter casting from several consumable electrodes because inhomogeneous regions, which can result from refining stoppage and consumable electrode changing operations, are avoided by the consumable electrode feed system 10, as embodied by the invention.

While various embodiments are described herein, it will be appreciated from the specification that various combinations of elements, variations or improvements therein may be made by those skilled in the art, and are within the scope of the invention.

We claim:

1. A consumable electrode feed system with connection platform for providing consumable electrodes to a refining system, the consumable electrode feed system comprising:

a side feed device that feeds consumable electrodes to a refining system in a first direction;

a refining feed device that feeds consumable electrodes to a refining system in a second direction, the second direction being generally orthogonal to the first direction, said refining feed device engaging said fed consumable electrodes both above and below said connection platform; and a connection system that connects fed consumable electrodes to each other, wherein as a sufficient amount of a consunmable electrode has been refined in the refining system, another consumable electrode is positioned above a previously consumable electrode by the side feed device, the connecting system connects a fed consumable electrode to a previously fed consumable electrode and avoids refining operation stoppage for providing consumable electrodes for refining.

2. A consumable electrode feed system according to claim 1, wherein the connection system comprises a weld connection system.

3. A consumable electrode feed system according to claim 1, wherein the connection system comprises at least one of weld connection systems, brazing connection systems, soldering connection systems, fusing connection systems, and combinations thereof.

4. A consumable electrode feed system according to claim 1, wherein the connection system provides a connection that supports the weight of consumable electrodes.

5. A consumable electrode feed system according to claim 1, wherein the connection system comprises a platform and a weld connection system, the weld connection system being disposed on the platform.

6. A consumable electrode feed system according to claim 1, wherein the side feed device comprises at least one of:

conveyors, cranes, tracks, lifts, and combinations thereof for orienting a consumable electrode in a disposition to be fed to the refining feed device.

7. A consumable electrode feed system according to claim 1, wherein the refining feed device comprises at least one of:

caterpillar devices, treaded devices, belt devices, chain devices, and combinations thereof for controlled movement of the consumable electrode to the refining system.

8. A consumable electrode feed system according to claim 1, wherein the refining feed device provides controlled movement of consumable electrodes to the refining system.

9. A consumable electrode feed system according to claim 8, wherein the controlled movement comprises a stepped movement.

10. A consumable electrode feed system according to claim 1, wherein the refining system comprises an electroslag refining system.

11. A consumable electrode feed system according to claim 10, wherein the electroslag refining system comprises a cold-induction-guide system.

12. A consumable electrode feed system according to claim 10, wherein the electroslag refining system comprises a passage that allows a consumable electrode to pass therethrough, the passage preventing contaminants from passing therethrough.

13. A method for feeding consumable electrodes to a refining system, the method of feeding comprising:

providing a connection platform;

feeding consumable electrodes to a refining system in a first direction, above the platform;

feeding consumable electrodes to a refining system in a second direction below the platform, the second direction being generally orthogonal to the first direction;

engaging said fed consumable electrodes with the refining system both above and below said connection platform;

connecting consumable electrodes to each other; and refining the consumable electrode as they are fed to the refining system;

whereby as a sufficient amount of a consumable electrode has been refined, feeding another consumable electrode, and connecting a fed consumable electrode to a previously fed consumable electrode for avoiding refining operation stoppage.

14. A method according to claim 13, wherein the step of connecting is: comprises connecting by welding, brazing, soldering, fusing, and combinations thereof.

15. A method according to claim 13, wherein the step of connecting provides a connection that supports the weight of consumable electrodes.

16. A method according to claim 13, wherein the step of feeding consumable electrodes in a first direction comprises feeding the consumable electrodes by at least one of:

conveyors, cranes, tracks, lifts, and combinations thereof for moving and orienting a consumable electrode to be fed to the refining feed device.

17. A method according to claim 13, wherein step of feeding consumable electrodes to a refining system comprises feeding with controlled movement by at least one device selected from:

caterpillar devices, treaded devices, belt devices, chain devices, and combinations thereof.

18. A method according to claim 13, wherein the step of feeding consumable electrodes to a refining system comprises controlled movement of consumable electrodes to the refining system.

19. A method according to claim 18, wherein the controlled movement comprises a stepped movement.

20. A consumable electrode feed system with connection platform for providing consumable electrodes to a refining means, the consumable electrode feed system comprising:

side feed means for feeding consumable electrodes to a refining system in a first direction;

refining feed means for feeding consumable electrodes to a refining system in a second direction, the second direction being generally orthogonal to the first direction, said refining feed device engaging said fed consumable electrodes both above and below said connection platform; and means for connecting fed consumable electrodes to each other, wherein as a sufficient amount of a consumable electrode has been refined, another consumable electrode is positioned above a previously consumable electrode by the side feed means, the connecting means connects a fed consumable electrode to a previously fed consumable electrode for avoiding refining stoppage during refining.

21. A consumable electrode feed system according to claim 20, wherein the means for connecting comprises welding means.

22. A consumable electrode feed system according to claim 20, wherein the means for connecting comprises at least one of welding means, brazing means, soldering means, fusing means, and combinations thereof.

23. A consumable electrode feed system according to claim 20, wherein the means for connecting provides a connection that supports the weight of consumable electrodes.

24. A consumable electrode feed system according to claim 20, wherein the means for connecting comprises a platform and welding means, the welding means being disposed on the platform.

25. A consumable electrode feed system according to claim 20, wherein the side feed means comprises at least one of:

conveyors, cranes, tracks, lifts, and combinations thereof for orienting a consumable electrode in a disposition to be fed to the refining feed means.

26. A consumable electrode feed system according to claim 20, wherein the refining feed means comprises at least one of:

caterpillar devices, treaded devices, belt devices, chain devices, and combinations thereof for controlled movement of the consumable electrode to the refining system.

27. A consumable electrode feed system according to claim 20, wherein the refining feed means provides controlled movement of consumable electrodes to the refining means.

28. A consumable electrode feed system according to claim 27, wherein the controlled movement comprises a stepped movement.

29. A consumable electrode feed system according to claim 20, wherein the refining means comprises passage means for allowing a consumable electrode to pass therethrough, the passage means preventing contaminants from passing therethrough.

30. A consumable electrode feed system with connection platform for providing consumable electrodes to an electroslag refining system, the electroslag refining system comprising a cold induction guide, the consumable electrode feed system comprising:

a side feed device for feeding consumable electrodes to a refining system in a first direction, above the platform, the side feed device being selected from at least one of conveyors, cranes, tracks, lifts, and combinations thereof for orienting a consumable electrode in a disposition to be fed to the refining feed device;

a refining feed device for feeding consumable electrodes to a refining system in a second direction, the second direction, below the platform, being generally orthogonal to the first direction, the refining feed device being selected from caterpillar devices, treaded devices, belt devices, chain devices, and combinations thereof for controlled movement of the consumable electrode to the refining system, said refining feed device engaging said fed consumable electrodes both above and below said connection platform; and a connection system for connecting fed consumable electrodes to each other, the connection system comprises at least one of weld connection systems, brazing connection systems, soldering connection systems, fusing connection systems, and combinations thereof, wherein as a sufficient amount of a consumable electrode has been refined in the refining system, another consumable electrode is positioned above a previously fed consumable electrode by the side feed device, the connecting system connects a fed consumable electrode to a previously fed consumable electrode and avoids refining operation stoppage for providing consumable electrodes for refining and the connection system provides a connection that supports the weight of consumable electrodes.

31. A consumable electrode feed system according to claim 30, wherein the controlled movement comprises a stepped movement.

32. A casting made by the process according to claim 13.

33. A turbine component made by the process according to clam 13.

34. A casting made by the system according to claim 1.

35. A turbine component made by the process according to claim 1.

36. A casting made by the process according to claim 30.

37. A turbine component made by the process according to claim 30.

38. An electroslag refining system comprising:

electroslag refining structure;

cold hearth structure;

a connection platform; and a consumable electrode feed system for providing consumable electrodes to the electroslag refining system, the consumable electrode feed system comprising:

a side feed device that feeds consumable electrodes to the electroslag refining system in a first direction, above the platform;

a refining feed device that feeds consumable electrodes to the electroslag refining system in a second direction, below the platform, the second direction being generally orthogonal to the first direction, said refining feed device engaging said fed consumable electrodes both above and below said connection platform; and a connection system that connects fed consumable electrodes to each other, wherein as a sufficient amount of a consumable electrode has been refined in the electroslag refining system, another consumable electrode is positioned above a previously fed consumable electrode by the side feed device, the connecting system connects a fed consumable electrode to a previously fed consumable electrode and avoids refining operation stoppage for providing consumable electrodes for refining by the electroslag refining system.

39. A consumable electrode feed system according to claim 38, wherein the electroslag refining system comprises a cold-induction-guide system.

40. A consumable electrode feed system according to claim 38, wherein the electroslag refining system comprises a passage that allows a consumable electrode to pass therethrough, the passage preventing contaminants from passing therethrough.

41. A casting formed by the electroslag refining system according to claim 38.

42. A turbine component formed by the electroslag refining system according to claim 38.

* * * * *